United States Patent [19]

Harris

[11] 4,304,430

[45] Dec. 8, 1981

[54] DOOR LOCK

[75] Inventor: Donald S. Harris, Dallas, Tex.

[73] Assignee: Overhead Door Corporation, Dallas, Tex.

[21] Appl. No.: 22,933

[22] Filed: Mar. 22, 1979

[51] Int. Cl.[3] ..... E05C 9/04

[52] U.S. Cl. ..... 292/336.3

[58] Field of Search ..... 292/175–181, 292/336.3, 153, 166, 167

[56] References Cited

U.S. PATENT DOCUMENTS

| | | | |
|---|---|---|---|
| 5,557 | 5/1848 | Reynolds . | |
| 1,302,063 | 4/1919 | Malone | 292/179 |
| 2,459,571 | 1/1949 | Mihalek et al. | 292/181 X |
| 2,475,478 | 7/1949 | Clair | 292/181 |
| 2,828,991 | 4/1958 | Stilger | 292/175 |
| 3,163,033 | 12/1964 | Boyles | 292/181 X |
| 3,306,086 | 2/1967 | Hallgren | 292/181 X |
| 3,958,820 | 5/1976 | Teeple | 292/181 X |

*Primary Examiner*—Richard E. Moore

*Attorney, Agent, or Firm*—Blanchard, Flynn, Thiel, Boutell & Tanis

[57] ABSTRACT

Lock and latch for a large door, particularly an upwardly opening type, including a housing with an elongated bolt slidably arranged therethrough. A manually operable crank is pivotally mounted within said housing and related to said bolt for moving same lineally upon pivotal movement of said crank. Lineally acting biasing means is operatively positioned between said bolt and said housing for continuously urging said bolt in a locking direction. A latch is pivotally mounted in said housing for movement into and out of a position to engage and releasably hold said bolt in its locked position. Second biasing means operatively positioned between said latch and said housing urges said latch toward said position. The latch and bolt are arranged so that the bolt can be released from its locked position with a minimum of force applied to said latch.

19 Claims, 9 Drawing Figures

DOOR LOCK

FIELD OF THE INVENTION

The invention relates to lock and latch means for large doors, particularly upwardly acting doors such as truck doors and/or garage doors. The invention relates particularly to such a lock means having a housing and a bolt extending therethrough responsive to manually applied force for operating same in one direction, normally the locking direction, and further responsive to a resiliently applied force urging same in the opposite direction, normally the unlocking direction.

BACKGROUND OF THE INVENTION

The art of locks and latches is an old art and a very large number of designs have been developed over the years for the purpose of locking or unlocking a door with respect to a supporting structure. Particularly in the art of applying locks to large doors, such as truck doors and garage doors, the mechanism required often becomes large and hence subject to a substantial amount of friction opposing movement of same. In response to this, it is known to mount resilient biasing means within a lock, tending to urge the locking mechanism in a selected direction, as the opening direction, and sufficient that the manual effort required to effect movement in such direction is at a minimum and may not be required at all.

It is further known in such art to apply resilient biasing means to the mechanism holding the lock mechanism in lock maintaining position. It is desirable, however, that while such force should be sufficient to prevent the lock from becoming loose under normal operating conditions, such as road shock in a truck or from blows applied to a door lock by would-be lock breakers, nevertheless it is still desirable that such holding means be capable of being retracted or rendered inoperative by the application of a relatively small force in the proper manner, such as by an operating lever or by a key.

In prior known locks, these problems have been recognized and dealt with and many prior-known locks have been generally satisfactory for their intended uses. One such lock is represented by Boyles U.S. Pat. No. 3,163,033, assigned to the same assignee as the present invention. While as indicated this lock is generally satisfactory, the spring force which assists the opening movement of the bolt is applied to said bolt through the crank and it is applied to the crank at both an awkward angle and at an adverse lever relationship and hence cannot achieve the most efficient results. Particularly, the angle at which such spring force is applied to the crank is at its most inefficient angle at the point of starting the bolt out of its unlocked position, namely the point at which there is the maximum friction resisting such movement. This results either in considerable manual force being required when the bolt is withdrawn from locked position or, if the spring is strengthened to assist this situation, then the force which must be manually applied to overcome such spring when the lock is returned to locking position is greater than desirable.

Another illustrative patent is Hallgren U.S. Pat. No. 3,306,086 wherein such biasing force is applied by a coil spring arranged around the mounting shaft for the crank. Since the lever arm at which such spring force is applied is even shorter than that in the Boyles patent above mentioned, the same situation as above described in connection with the Boyles patent exists here also.

Therefore, in a continuing effort to improve locks of this nature, the present invention has addressed itself to the points above mentioned as well as to others.

Accordingly, the objects of the invention include:

1. To provide a lock particularly applicable to large doors, such as truck and/or garage doors, wherein a resiliently applied force can be utilized for assisting the moving of a locking bolt from a first, as locked, position to a second, as unlocked, position and wherein such force will be applied to said bolt with such efficiency that it can be of minimum magnitude whereby to require a minimum manually applied force for overcoming same for effecting movement of said bolt in the reverse direction.

2. To provide a lock, as aforesaid, in which the adverse lever relationships previously existing between the means generating such resiliently applied force are eliminated and such force is applied to the bolt in a more efficient manner for the purposes aforesaid.

3. To provide a lock, as aforesaid, in which such resilient force is applied in a lineal direction directly onto said bolt.

4. To provide a lock, as aforesaid, having a latch providing interference with appropriate means on the bolt for holding same against movement out of its locked position in response to said resiliently applied force wherein the surfaces effecting said interference are sufficiently small that, while effective, the latch can be easily moved out of its bolt holding position by a relatively small force applied to the latch.

5. To provide a lock having the advantages aforesaid with a minimum of structural change over locks presently known so as to require a minimum of new tooling and to be capable of easy fabrication for either left hand or right hand assembly and installation.

6. To provide a lock, as aforesaid, which will be of simple construction, sturdy, highly resistant to damage by vibration or blows, and capable of long and reliable use under adverse conditions.

Other objects and purposes of the invention will be apparent to persons acquainted with devices of this general type upon reading the following specification and inspecting the accompanying drawings.

Figure 1:
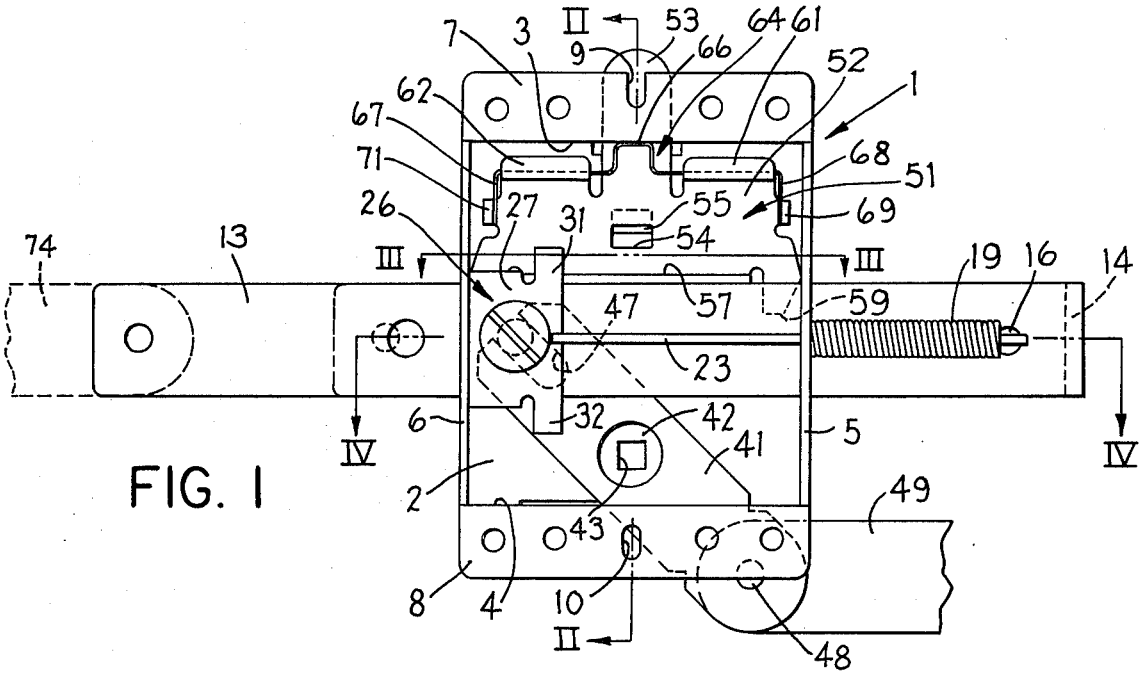
FIG. 1 is an elevational view of one side of a lock assembly embodying the invention.

For convenience in description the terms "upper", "lower", "front", "rear", and words of similar import will have reference to the lock assembly as appearing in FIG. 1. The terms "inner", "outer" and derivatives thereof will have reference to the geometric center of said lock assembly and components thereof.

DETAILED DESCRIPTION

FIG. 1 of the drawings, which discloses a preferred embodiment, illustrates a lock assembly embodying the invention and which is adapted for either center mounting or for right hand or left hand edge mounting as desired. For illustrative purposes, it will be assumed that the lock is center mounted on a garage door but it will be recognized that same may also be so mounted on a lift-type door for the cargo space of a truck, for warehouse doors, or any other large doors where a strong but versatile lock is required.

Figure 4:
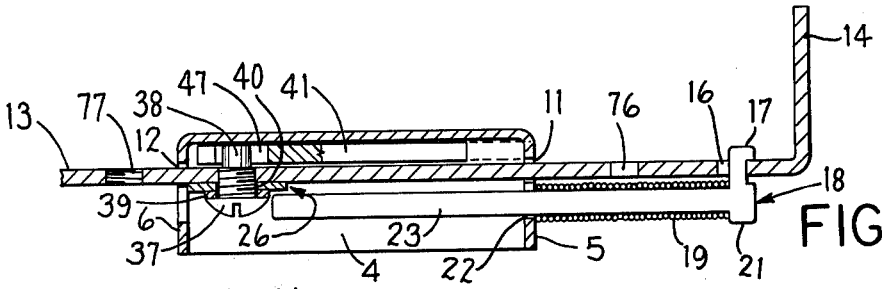
FIG. 4 is a sectional view taken on the line IV—IV of FIG. 1.
Figure 3:
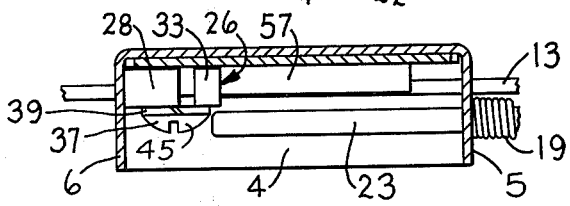
FIG. 3 is a sectional view taken on the line III—III of FIG. 1.

The lock is comprised of a generally rectangular box-shaped housing 1 (FIG. 1) having a front panel 2, upper and lower end panels 3 and 4, side walls 5 and 6, and top and bottom mounting flanges 7 and 8, respectively. Same may be formed in any convenient manner, such as in this instance by being die-formed from a single sheet of metal. Appropriate mounting means of any desired nature, here a slot 9 and a hole 10, are provided on and/or in association with the mounting flanges 7 and 8. A pair of aligned openings 11 and 12 (FIG. 4) are provided in the side walls 5 and 6 for the reception therethrough of a lock bolt 13, same being substantially of presently known size and shape and having a bent-over portion 14 at one end thereof to assist in the manual operation of said lock bolt, as needed, from the inside of the door.

An opening 16 is provided in said bolt near the bent-over end 14 which receives a hook portion 17 (FIG. 4) of a spring guide 18 having a rod 23 around which is wrapped a biasing spring 19. Said spring 19 is compressed between the wall 5 and a suitable abutment 21 adjacent the hook 17 on the end of the guide 18. A further opening 22 is provided in said wall 5 in order that the rod 23 of the spring guide 18 may extend therethrough.

The length of the rod 23 and the extent of the hook 17 are preferably such that disengagement of the rod 23 from the bolt 13 is prevented by the screw 37.

Figure 7:
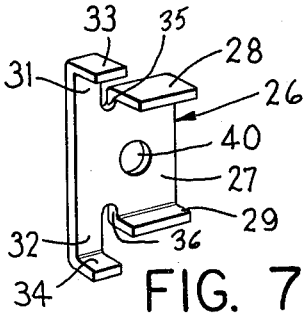
FIG. 7 is an oblique view from the same direction as in FIG. 6 of a component of the apparatus.
Figure 6:
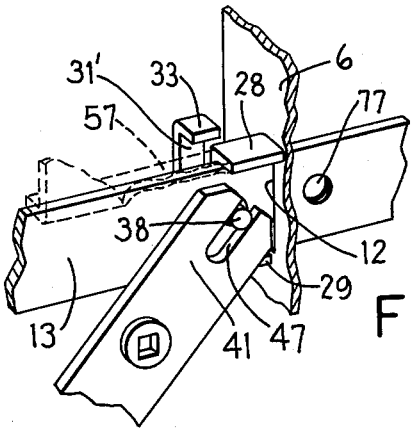
FIG. 6 is an oblique detail of a portion of the apparatus from the side thereof opposite that shown in FIGS. 1 and 5.

A saddle 26 (FIGS. 1 and 7) is secured to the bolt 13 by the pivot screw 37. Said saddle 26 comprises a body part 27 of generally flat nature, a pair of bent-over flanges 28 and 29 which embrace the upper and lower edges of the bolt 13 (FIG. 6), and a pair of coplanar tabs 31 and 32 (FIG. 7) which have parallel flanges 33 and 34 at the respective upper and lower ends thereof. The tab 31 provides with the flange 28 a notch 35 for purposes appearing hereinafter and the tab 32 provides with the flange 29 a similar notch 36.

The pivot screw 37 extends through a suitable opening 40 in the saddle 26 and is tapped into the bolt 13 for holding the saddle firmly in place on said bolt. Said pivot screw has a pivot portion 38 which extends beyond the bolt 13 for purposes appearing hereinafter. A lock washer 39 may be provided as desired. The head 45 of the screw 37 is shaped so that the adjacent end of the rod 23 can bear against said head 45, thereby holding said rod 23 against accidental disconnection from the bolt 13.

A crank 41 (FIG. 1) is pivotally mounted on the front panel 2 by conventional means such as a circular offset or boss 42 on said crank extending into a corresponding opening in the front panel 2 and constituting in effect a trunnion and bearing for said crank. A non-circular, as square, opening 43 is provided through the boss 42 for the reception of a correspondingly shaped rod 44 (FIG. 2) for carrying one or two operating handles 46 as desired.

A slot 47 (FIG. 1) in the upper end of said crank 41 embraces the projecting end 38 of the pivot screw 37 whereby pivotal movement of said crank will drive the bolt 13 lineally as desired. An opening 48 is provided in the lower end of said crank 41 for attachment, if desired, of an appropriate connecting link 49, as where the lock is mounted near the center of the door.

Figure 5:
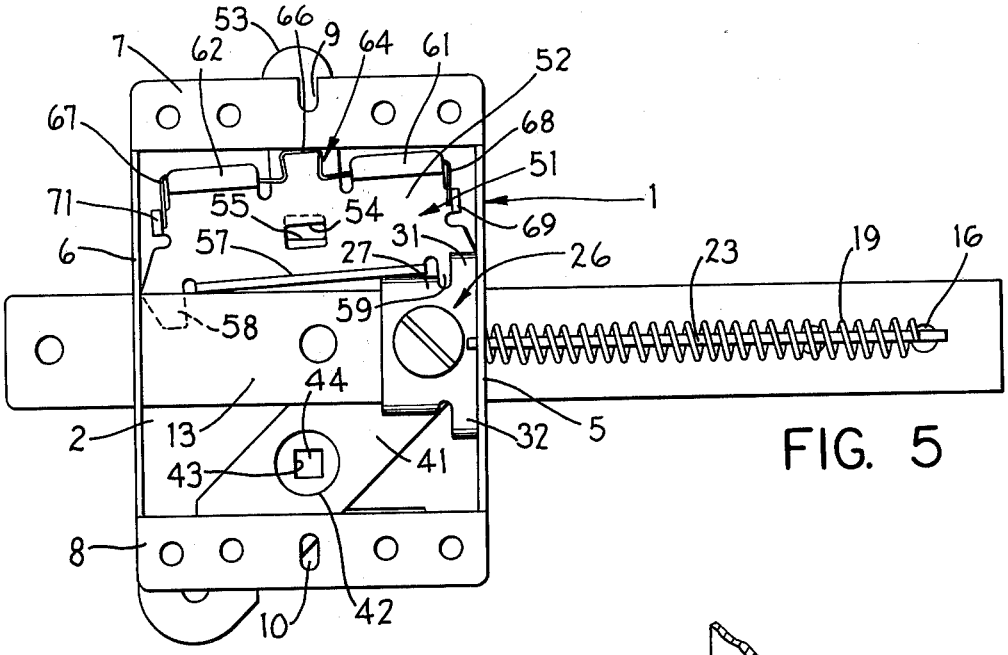
FIG. 5 is a view generally similar to FIG. 1 but showing the apparatus in a different operative position.

Thus, the biasing spring 19 will normally urge the bolt 13 toward its rightward or unlocked position as appearing in FIG. 5. Counterclockwise (as seen in FIGS. 1 and 5) rotation of the rod 44 will similarly rotate the crank 41 and drive the bolt 13, against the urging of said spring 19, leftwardly into the position shown in FIG. 1.

Figure 2:
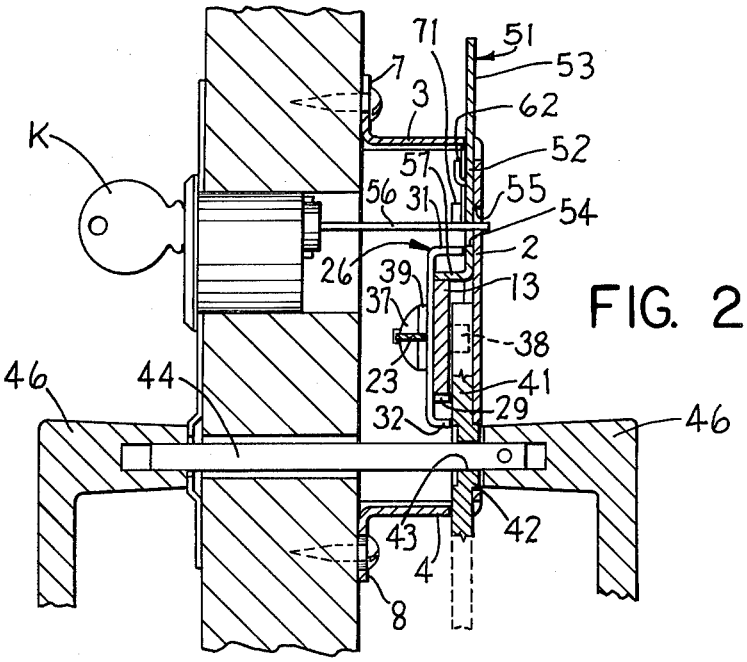
FIG. 2 is a sectional view taken on the line II—II of FIG. 1.

A latch 51 (FIG. 1) includes a base plate 52 which is parallel with and adjacent to the front panel 2. The latch 51 is floatingly disposed, as described further hereinafter, within the housing or box 1 and with respect to the bolt 13. Latch 51 has a lever 53 which extends upwardly through an opening in the upper wall 3 (FIG. 2) for manual operation thereof. Said latch has a non-circular slot 54 (FIG. 1) therethrough for reception of a conventional lock tang 56 and has an inwardly turned flange 57 along the bottom edge thereof. A further slot 55 is provided in the front panel 2 in at least partial register with all positions of the slot 54 as said latch 51 is moved as hereinafter further described, in order that the lock tang 56 may extend therethrough as shown in FIG. 2.

Figure 9:
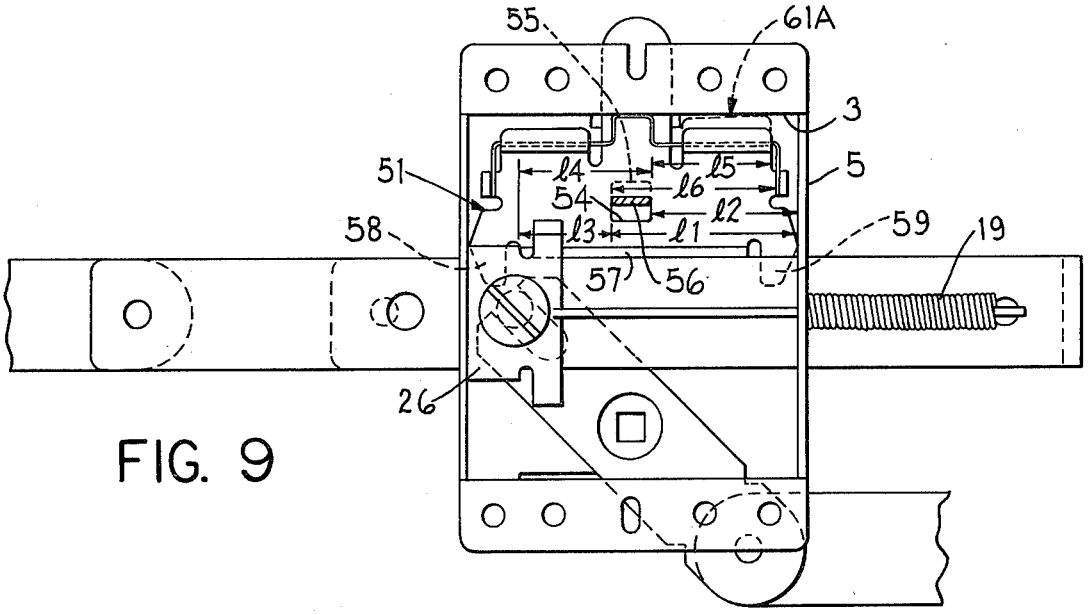
FIG. 9 is substantially a duplicate of FIG. 1 with lever arms indicated therein.

The leftward edge, as appearing in FIG. 1, of said flange 57 is positioned to engage with the turned-over flange 28 (FIG. 7) of the saddle 26 when the bolt 13 is in its locked position of FIG. 1, whereby to prevent rightward movement of the saddle 26 and thereby to prevent rightward movement of the bolt 13 in response to the urging of the biasing spring 19. Downwardly extending tabs 58 and 59 (FIG. 9) on the latch 51 are disposed snugly between the bolt 13 and front wall 2 in order to retain, and guide the movement of, said latch 51 with respect to the bolt 13.

A pair of inwardly offset and upwardly extending ears 61 and 62 (FIG. 5) receive and retain a wire spring 64, which has a central raised portion 66 between said ears and bearing against the lower surface of the upper side 3. Said spring 64 has a pair of downwardly bent ends 67 and 68 which are retained inwardly of flanges 69 and 71 on the latch 51. Thus, said spring tends to level said latch and urge its flange 57 against said bolt 13 as shown in FIG. 1, but permits said latch to be pivotally rocked as required to release the flange 57 from its position of engagement with the flange 28.

The latch 51 thus floats between the side panels 5 and 6 (FIG. 1) and between the upper wall 3 (FIG. 2) and the upper edge of the bolt 13 with the resiliency of the spring 64 permitting said latch to move in a rocking manner in response either to sidewise movement of the lever 53 or rotative movement of the above-mentioned tang 56.

When said latch 51 is rocked or rotated in either the clockwise or the counterclockwise direction, as appearing in FIG. 1, the leftward end of the flange 57 will normally be raised away from its engagement with the saddle 26 whereby the bolt is released from its locked position of FIG. 1 and moved by spring 19 to its unlocked position of FIG. 5. This release is due to the fact that the right edge of the tab 59 is forced against the right wall 5 by the spring 19, and the force of the frictional engagement between the flange 57 and saddle 26 is less than that of the engagement between the tab 59 and the wall 5. Release of the flange 57 from the saddle 26 is also augmented by the fact that the lever arm $l_1$ (FIG. 9) resulting from a clockwise rotation of the tang 56 is considerably longer than the lever arm $l_3$. Also, the lever arm $l_2$ is slightly longer than the lever arm $l_4$, in the event that the tang 56 is rotated in the counterclockwise direction. However, even if the lever arms $l_2$ and $l_4$ were about equal and the frictional engagement between the saddle 26 and flange 57 was about equal to such engagement between the tab 59 and wall 5, so that the right end of the latch 51 is raised first, the latch 51 still provides a substantial mechanical advantage and relatively easy release of the bolt 13. That is, the right end of the latch 51 would move upwardly until the right end of the ear, shown by broken lines at 61A in FIG. 9, would engage the top wall 3 to provide a pivot point therebetween. Thus, further upward raising of the latch 51 by the tang 56 (in either direction of rotation) would pivot the latch around the pivot between ear 61A and wall 3 with a lever arm $l_5$ or $l_6$.

The flange 33 (FIG. 7) may be utilized to restrict the upward movement of the left end of the flange 57 (FIG. 9) and/or the frontward movement of the latch 51.

In the present mode of assembly the leftward, as appearing in FIG. 1, end of the bolt 13 may extend directly into appropriate receiving means on the door jamb or same may be connected to an extension bar 74 for cooperation with such receiving means as required for center mounting of the lock assembly.

Supplemental openings 76 and 77 (FIG. 4) may be provided in the bolt 13 for reception of the hook 17 and the pivot screw 37, respectively, where space requirements make it desirable to mount the bolt in a normal position rightwardly of the arrangement shown in FIG. 1. Further such openings may be provided if desired to the extent needed to accommodate whatever space requirements may exist.

OPERATION

The operation of the lock assembly has already been somewhat indicated in the foregoing description, but will be reviewed hereinafter in the interest of providing a better understanding of the invention.

Assuming for purposes of illustration that FIGS. 1–4 illustrate the lock assembly in its locked position, the spring 19 exerts a continuing force onto the bolt 13 urging it out of its locked position whereby there is engagement between the flange 28 and the flange 57 which prevents the bolt from responding to such urging. Also, the spring 19 acts through the saddle 26 and latch 51 to force the tab 59 against the wall 5. Thus, so long as the latch 51 remains in its FIG. 1 position, the bolt 13 will remain in the locked position.

Pivotal movement of the latch 51 may be effected either by manual engagement of the lever 53 or by rotation of a suitable key K acting through a conventional tang 56. Such pivotal movement of latch 51 lifts the leftward end of the flange 57 upwardly and out of interfering position with respect to the flange 28 whereupon the bolt may now respond to the urging of the spring 19 and move rightwardly out of its locked position. The crank 41 will be impelled by pivot screw 37 to follow the movement of the bolt 13. At this point, the spring 64 will urge the latch back to its normal position, but the flange 57 will remain on top of the flange 28, as shown in FIG. 5, and thereby prevent movement of the flange 57 into full engagement with the bolt 13.

When it is desired to return the bolt 13 to the locked position, either of the handles 46 may be grasped and rotated to rotate the rod 44 in the counterclockwise direction as seen in FIG. 1 and thereby rotate the crank 41 similarly. This acts through the extension 38 of the screw 37 to drive the bolt 13 leftwardly as appearing in FIG. 1 to the position shown therein. As the flange 28 clears the left end of the flange 57, the spring 64 acts to urge the leftward end of the flange 57 downwardly so that same is again in a position interfering with rightward movement of the said flange 28. The lock is now back to its normal locked position, as above described, in which position it will remain until the latch is again released.

Alternatively, the bolt 13 can be moved to its locked position of FIG. 1 by manually engaging the flange 14 on bolt 13 and moving it leftwardly or by manually engaging the crank 41 and pivoting it in a counterclockwise direction (FIG. 1).

Figure 8:
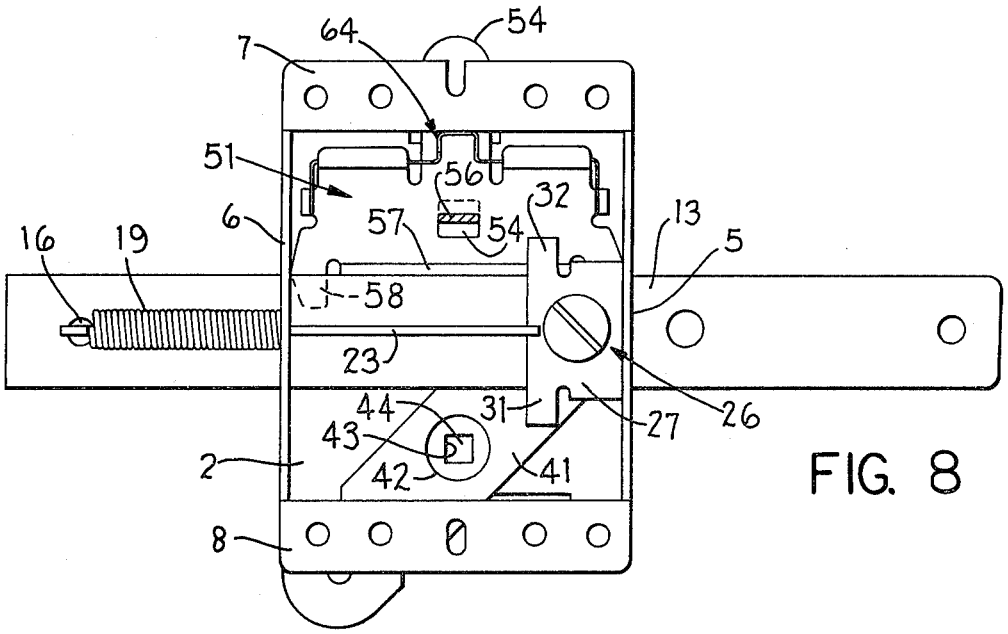
FIG. 8 is a view generally similar to that of FIG. 1 but showing the lock assembled for actuation in a direction opposite to that of the assembly of FIGS. 1 to 5.

The lock assembly of FIGS. 1 and 5 is arranged for center or right hand mounting and operation as appearing from the front side or outside of the door upon which the lock is mounted. However, it will be recognized that all of the parts above described are designed so that same may be assembled and mounted in the reverse or left hand arrangement if desired and as shown in FIG. 8. This arrangement being an exact mirror image of the arrangement above described in connection with FIGS. 1–4, no detailed description will be required excepting to point out that the saddle 26 is inverted with respect to the position shown in FIG. 1, so that the rightward end of the flange 57 engages with the leftward edge of the flange 29 and the flange 34 can now be used to restrict the upward movement of the rightward end of the flange 57.

Thus, the lock may be positioned for right hand edge mounting, left hand edge mounting, or center mounting as desired without requiring other than minor rearrangement of the parts herein shown and described. No further or special parts are needed.

The reaction of the spring 19 is in either assembly applied to the bolt 13 in such a manner that the maximum force of the spring is applied when the bolt is first being released from its locked position and the resisting force of friction is likewise at its maximum value. Thus, the efficiency of said spring 19 is at its maximum when needed, which minimizes the size of the spring required. This minimizes the amount of force required to move the bolt against the force of the spring into its locked position.

The wire spring 64 effects the desired positioning of the latch 51 regardless of the right hand or left hand assembly of the remaining parts and no change is required for this component when the lock is rearranged between a right hand and left hand assembly.

Since the interfering surfaces holding the lock in its locked position, namely the flanges 28 and 57 in the assembly of FIG. 1 or the flanges 29 and 57 in the assembly of FIG. 8, are relatively small, the amount of movement of the latch 51 required to release the bolt will also be relatively small. Thus, the lock in either assembly arrangement responds to either the opening or closing function easily and requires for either function a minimum of effort by the operator. The lock is nevertheless stable and will reliably hold itself in either the locked or unlocked position until actuated.

The foregoing has set forth rotative means, such as the tang 56, employed to lift the latch 51 out of interfering relationship with the saddle 26. It will be evident in the light of the foregoing that other means may be employed as desired to effect a rotation of the latch 51.

Although particular preferred embodiments of the invention have been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A lock assembly mountable upon a door comprising:

a housing having a front wall and edge wall means having a pair of opposing portions;

elongated bolt means slidably extending through substantially aligned openings in said pair of opposing portions for lengthwise movement between a locked position and an unlocked position;

first stop means on said bolt means externally of said housing means;

spring means disposed between said first stop means and the adjacent one of said opposing portions, said spring means being compressed when said bolt means is in said locked position;

second stop means on said bolt means between said pair of opposing portions;

manually operable latch means disposed within said housing for limited relative movement with respect to said housing and said bolt means, said latch means including a latch member floatingly supported for movement within said housing and having catch means thereon engageable with said second stop means for releasably holding said bolt means in said locked position; and resilient means urging said latch means toward said position of engagement between said catch means and said second stop means.

2. The lock assembly of claim 1 including crank means pivotally mounted upon said front wall, one end of said crank means extending through an opening in said edge wall means and the other end being pivotally and slidably connected to said bolt means near said second stop means.

3. The lock assembly of claim 1, wherein said latch member comprises plate means parallel with and adjacent to said front wall and said catch means comprises flange means in said plate means releasably engageable at one end thereof with said second stop means when said bolt means is in said locked position, said plate means having a coplanar extension penetrating said edge wall means for effecting manual release of said latch means and having an edge urged against said one opposing portion when said bolt means is in said locked position.

4. The lock assembly of claim 1, including an edge on said latch member which is urged against said one opposing portion when said bolt means is in said locked position, out-of-round openings in said front wall and said latch member which are at least partially aligned during normal operation and flat element means extending through said openings, whereby rotation of said flat element means about an axis perpendicular to said front wall causes said latch member to pivot about the point of contact between said edge of said latch member and said one opposing portion, thereby releasing said catch means from said second stop means so that said spring means moves said bolt means away from said locked position.

5. The lock assembly of claim 4, wherein said resilient means is a wire spring.

6. A lock assembly mountable upon a door comprising:

a housing having a front wall and edge wall means having a pair of opposing portions;

elongated bolt means slidably extending through substantially aligned openings in said pair of opposing portions for lengthwise movement between a locked position and an unlocked position;

first stop means on said bolt means externally of said housing means;

spring means disposed between said first stop means and the adjacent one of said opposing portions, said spring means being compressed when said bolt means is in said locked position;

second stop means on said bolt means between said pair of opposing portions;

manually operable latch means disposed within said housing for limited relative movement with respect to said housing and said bolt means, said latch means having catch means thereon engageable with said second stop means for releasably holding said bolt means in said locked position;

resilient means urging said latch means toward said position of engagement between said catch means and said second stop means; and an elongated rigid element arranged generally parallel with said bolt means and held against movement relative thereto, said spring means comprising a coil spring encircling said element externally of said housing.

7. A lock assembly mountable upon a door comprising:

a housing having a front wall and edge wall means having a pair of opposing portions;

elongated bolt means slidably extending through substantially aligned openings in said pair of opposing portions for lengthwise movement between a locked position and an unlocked position;

first stop means on said bolt means externally of said housing means;

spring means disposed between said first stop means and the adjacent one of said opposing portions, said spring means being compressed when said bolt means is in said locked position;

second stop means on said bolt means between said pair of opposing portions;

manually operable latch means disposed within said housing for limited relative movement with respect to said housing and said bolt means, said latch means having catch means thereon engageable with said second stop means for releasably holding said bolt means in said locked position; and resilient means urging said latch means toward said position of engagement between said catch means and said second stop means; and rod means connected to said first stop means, extending through said one opposing portion and being generally parallel with said bolt means, said spring means comprising a coil spring encircling said rod means between said first stop means and said one opposing portion.

8. The device of claim 7, wherein said rod means extends between abutments on said first and second stop means, which abutments prevent dislodgement of said rod means from said bolt means.

9. A lock assembly mountable upon a door comprising:

a housing having a front wall and edge wall means having a pair of opposing portions;

elongated bolt means slidably extending through substantially aligned openings in said pair of opposing portions for lengthwise movement between a locked position and an unlocked position;

first stop means on said bolt means externally of said housing means;

spring means disposed between said first stop means and the adjacent one of said opposing portions, said spring means being compressed when said bolt means is in said locked position;

second stop means on said bolt means between said pair of opposing portions comprising a generally U-shaped saddle, the central portions of said U being rigidly fixed to a vertical face of said bolt means and the arms of said U extending above and below said bolt means;

manually operable latch means disposed within said housing for limited relative movement with respect to said housing and said bolt means, said latch means having catch means thereon engageable with one of said arms of said saddle for releasably holding said bolt means in said locked position against the urging of said spring means; and resilient means urging said latch means toward said position of engagement between said catch means and said second stop means.

10. The lock assembly of claim 9, including crank means pivotally mounted upon said front wall, one end thereof extending between said bolt means and said front wall, and wherein said saddle is fixed to said bolt means by screw means having a portion projecting beyond said bolt means and engageable with said crank means for operatively interconnecting said crank means and said bolt means.

11. A lock assembly mountable upon a door comprising:

a housing having a front wall and edge wall means having a pair of opposing portions;

elongated bolt means slidably extending through substantially aligned openings in said pair of opposing portions for lengthwise movement between a locked position and an unlocked position;

first resilient means cooperable with said housing and said bolt means for urging said bolt means toward said unlocked position;

stop means on said bolt means between said pair of opposing portions;

latch means disposed within said housing for limited relative movement with respect to said housing and said bolt means, said latch means including a latch member floatingly supported for movement within said housing and having catch means thereon engageable with said stop means for releasably holding said bolt means in said locked position;

second resilient means urging said latch means toward said position of engagement between said catch means and said stop means; and release means for moving said latch means to effect a release of said engagement between said catch means and said stop means.

12. The lock assembly of claim 11, wherein said floatingly supported latch member is free of connections to said housing which limit movement in directions parallel to said front wall.

13. The lock assembly of claim 11, wherein said floatingly supported latch member is free of pivotal connections to said housing.

14. The lock assembly of claim 11, wherein an edge of said latch member is engageable with a point of contact on said edge wall means, and wherein said movement of said latch means by said release means is a pivotal movement about said point of contact.

15. The lock assembly of claim 14, wherein said point of contact on said edge wall means is adjacent one of said aligned openings in said opposing portions of said edge wall means, and wherein said edge of said latch member is urged against said point of contact on said edge wall means by said first resilient means acting through said stop means and said catch means when said bolt means is in said locked position.

16. The lock assembly of claim 14, wherein said latch member is disposed between said bolt means and said portion of said edge wall means having said point of contact thereon, and wherein said engagement between said edge of said latch member and said edge wall means limits rotation of said latch member about the point of engagement between said stop means and said catch means.

17. The lock assembly of claim 14, wherein a slot is provided in said edge wall means and said release means is a manually operable lever on said latch member which extends through said slot.

18. The lock assembly of claim 14, wherein said release means comprises out-of-round openings provided in said front wall and said latch member which are at least partially aligned during normal operation and flat element means extending through said openings, said flat element means being rotatable about an axis substantially perpendicular to said front wall to effect said pivotal movement for releasing said latch member.

19. The lock assembly of claim 11, wherein:

said front wall is substantially vertical and said edge wall means includes a top wall extending between said pair of opposing portions and spaced above said bolt means, said top wall having a slot therein intermediate said opposing portions;

said latch member is substantially planar and is disposed parallel with and adjacent to said front wall between said bolt means and said top wall and between said pair of opposing portions, said floating movement of latch member being in directions lying within the plane of said latch member;

a laterally extending first tab is provided on each side of said latch member and is engageable with the adjacent one of said opposing portions near said aligned opening therethrough to laterally limit said floating movement and to serve as a fulcrum for pivotal movement of said latch member;

a pair of spaced, upwardly extending second tabs are provided on the upper edge of said latch member, each of which is engageable with said top wall to limit upward movement of said latch member and to serve as a fulcrum for pivotal movement of said latch member;

a flange is provided along the lower edge of said latch member which is engageable with said bolt means to limit downward floating movement of said latch member, said catch means being an end of said flange which is releasably engageable with said stop means when said bolt means is in said locked position;

said second resilient means comprise a wire spring disposed between said top wall and said second flange means to urge said latch member downwardly; and said release means comprises an upright, manually operable lever on said latch means which extends through said slot in said top wall and also comprises out-of-round openings in said front wall and said latch member which are at least partially aligned during normal operation.

* * * * *